United States Patent [19]

Del Puppo

[11] 3,970,205

[45] July 20, 1976

[54] APPARATUS FOR HANDLING LARGE AND HEAVY OBJECTS

[75] Inventor: Louis Del Puppo, Saint-Genis-les-Ollieres, France

[73] Assignee: Societe Anonyme: SABLA, Dardilly, France

[22] Filed: Dec. 17, 1974

[21] Appl. No.: 533,629

[30] Foreign Application Priority Data

June 27, 1974 France ..... 74.23065

[52] U.S. Cl. ..... 214/652; 214/DIG. 1; 214/DIG. 3; 214/1 Q; 214/147 R

[51] Int. Cl.[2] ..... B66C 1/42

[58] Field of Search ..... 214/650 R, 651, 652, 214/653, 654, DIG. 1, DIG. 3, DIG. 4, 1 Q, 147 R

[56] References Cited

UNITED STATES PATENTS

| | | | |
|---|---|---|---|
| 2,799,417 | 7/1957 | Morrell | 214/652 X |
| 2,958,435 | 11/1960 | Schmidgall | 214/652 |
| 3,272,364 | 9/1966 | Mindrum et al. | 214/650 R X |

*Primary Examiner*—Frank E. Werner
*Attorney, Agent, or Firm*—Lewis H. Eslinger

[57] ABSTRACT

Apparatus for handling heavy and/or large objects which are at least partly perforated, comprising an automobile lift-truck of which the vertically sliding apron bears a nipper for gripping and tipping the object to be handled, an articulated chassis or cradle for supporting said object while it is being tipped over and a rigid projection penetrating into said object while it is tipping over in order thereafter to ensure the lifting and transporting thereof.

2 Claims, 8 Drawing Figures

Figure 1:
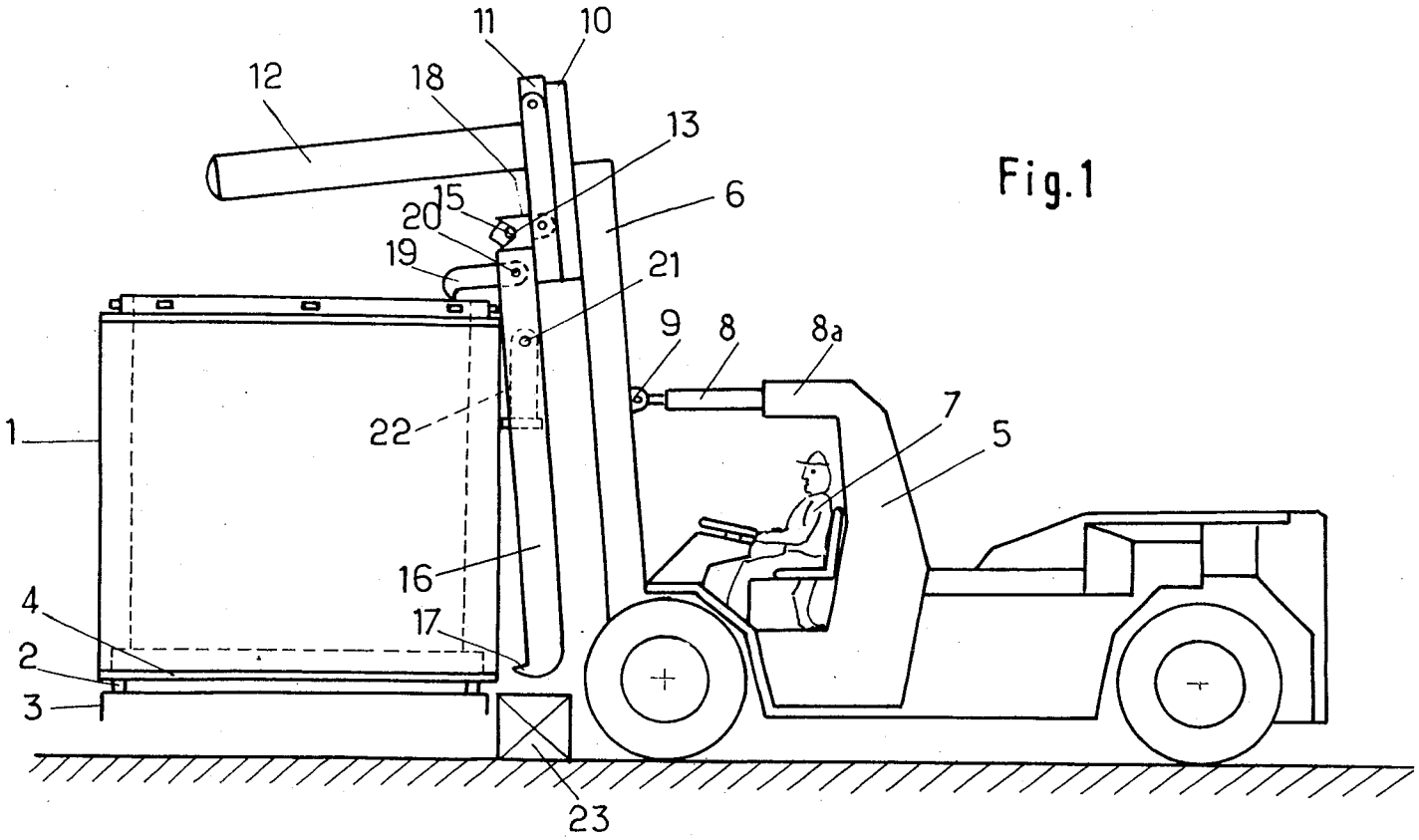

1
3
5
6
7
10
11
12
13
16
17
19
22
23

APPARATUS FOR HANDLING LARGE AND HEAVY OBJECTS

The present invention relates to a method of handling objects which are large, heavy, or both, solid or perforated (right through or partially), generally of revolution, such as in particular prisms or cylinders which are most often straight.

The invention is applied more particularly to the handling of annular cylinders of large dimensions resting on one of their bases, such as concrete pipes whose diameter is as wide as their length.

Such pipes are generally made by filling an annular chamber defined externally by a cylindrical mould and internally by a retractable core, the two bases being held by discs. When the pipe is obtained in this way, it should be removed from the place of production as quickly as possible to undertake a second operation and guide it to an enclosure where it undergoes a continuous treatment for several hours, under determined conditions of humidity and temperature, said treatment starting off the drying operation of the material and giving a product of constant characteristics.

As long as the pipes in question are small or average in size, the handling operations are carried out without too much difficulty. However, when the cylinders are large, for example from two and even up to three meters in length and diameter, serious problems are met with. In general, in this case, either nippers in the form of tongs which are mounted on lift-trucks or nippers mounted on gantries or travelling cranes are used.

In the first case, the first drawback encountered is that, when very heavy parts are being handled (weighing around ten tons), voluminous, heavy and bulky nippers are required, hence an extra large truck is needed, which is therefore more bulky and more expensive, to be able to transport the supplementary dead-weight constituted by these nippers. Moreover, as the jaws of the nippers are inevitably of large dimensions, in view of the masses to be maneuvered, a large space is necessary to remove them when the cylinder being handled has been placed on its side.

These various operations might be admissible when operation is carried out at a fixed site and when it is required to recover the removable discs on which the concrete pipes are made, but they can no longer be allowed when these cylinders have to be stored in a storage area of relatively limited dimensions or are to be loaded onto lorries. In this latter case, it is even impossible to dispose pipes crosswise on the lorries, as would be desirable, when they are of such a length as to give lorry/load assembly a profile which is outside the road gauge.

It should also be pointed out that as the cylinder-laying operation takes up only a small fraction of the day, the truck carrying the nipper is idle for most of the time, and this makes it necessary to have a second lift truck provided with a "projection," a sort of large horizontal bar to be inserted in the cylinders which are lying on their sides, to lift them up, support them, move them over the storage areas and then to load them onto the lorries.

It might certainly be wondered why it was not possible for one carriage only to be equipped both with the nippers and the projection, successively, but the complexity of the operations to be carried out to make this substitution would mean that several hours would be wasted every day.

In all, therefore, the truck/nipper system is not satisfactory.

The same applies to the second system constituted essentially of a mobile metal framework, such as a gantry or travelling crane. In this case, in fact, the surface covered by these constructions is necessarily limited, and a second truck, such as a lift-truck with projection, has to be employed to effect parking and loading on conveying vehicles. Finally, in this case too, two handling apparatus are required, which is not at all economical.

The present invention relates to a process which makes it possible to obviate the above-mentioned drawbacks, in that one mobile machine is used which can effect all the operations involved in handling large concrete pipes. The invention also relates to an apparatus for carrying out this method.

Figure 2:
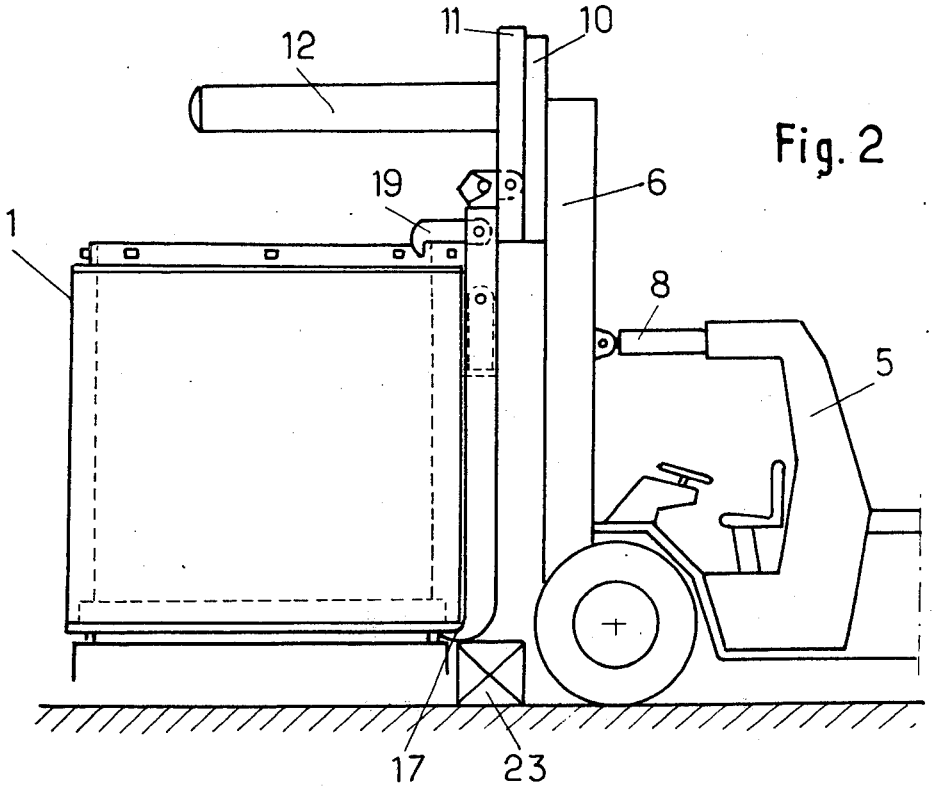
Figure 3:
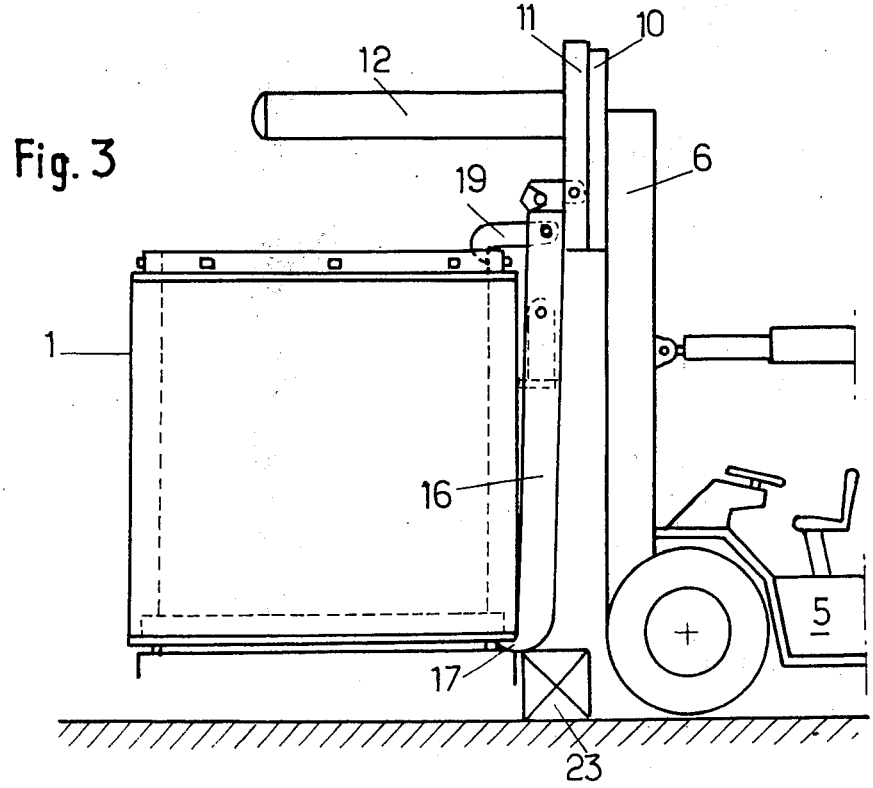
Figure 4:
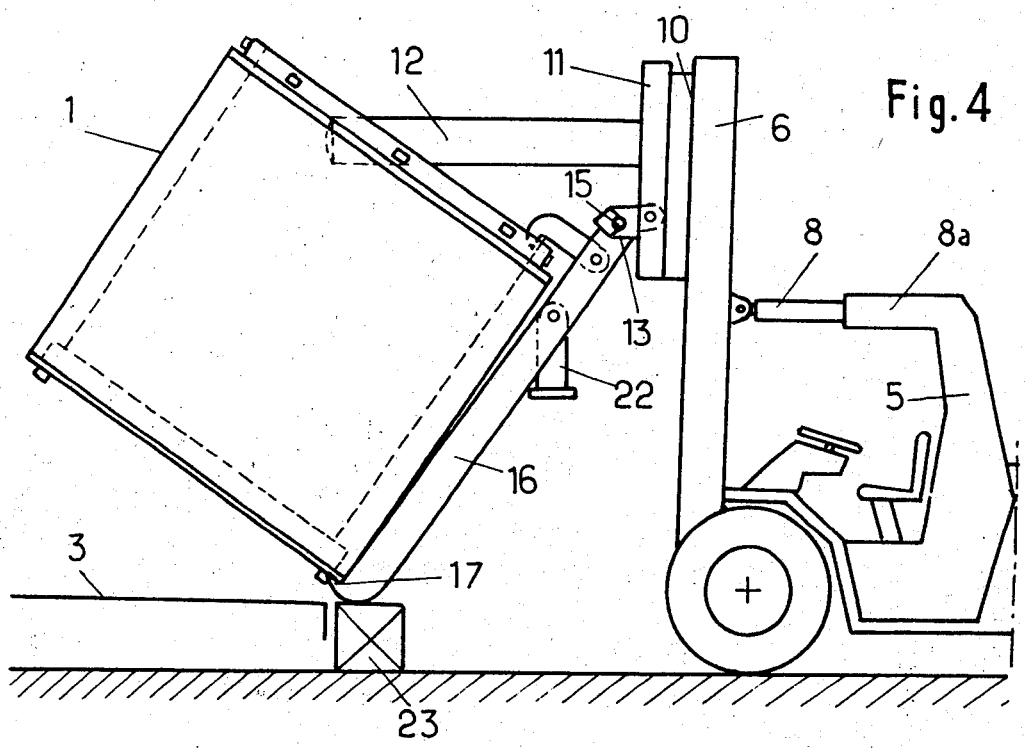
Figure 5:
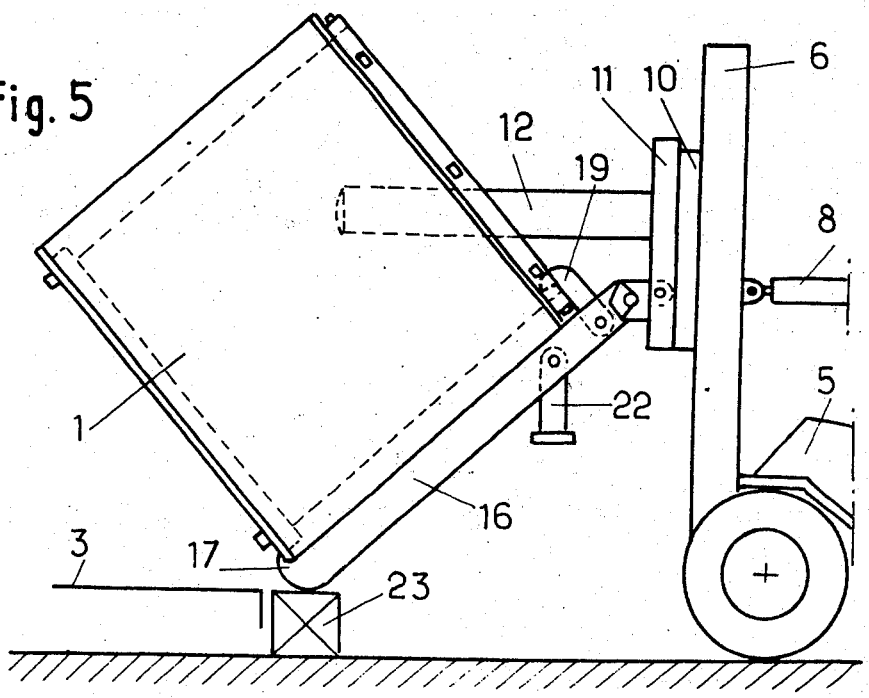
Figure 6:
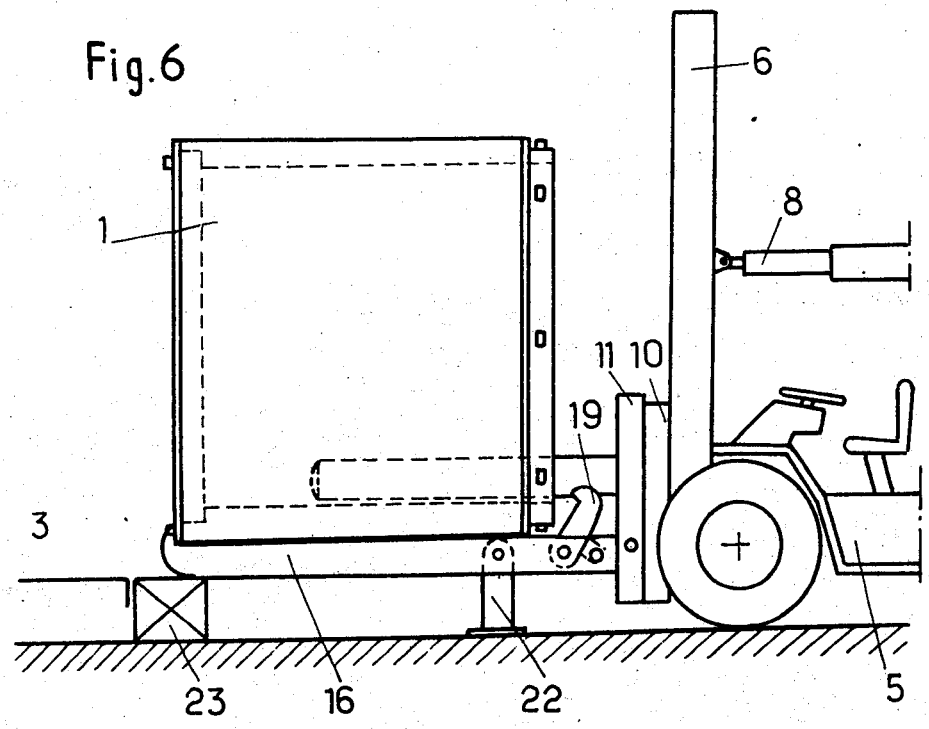
Figure 7:
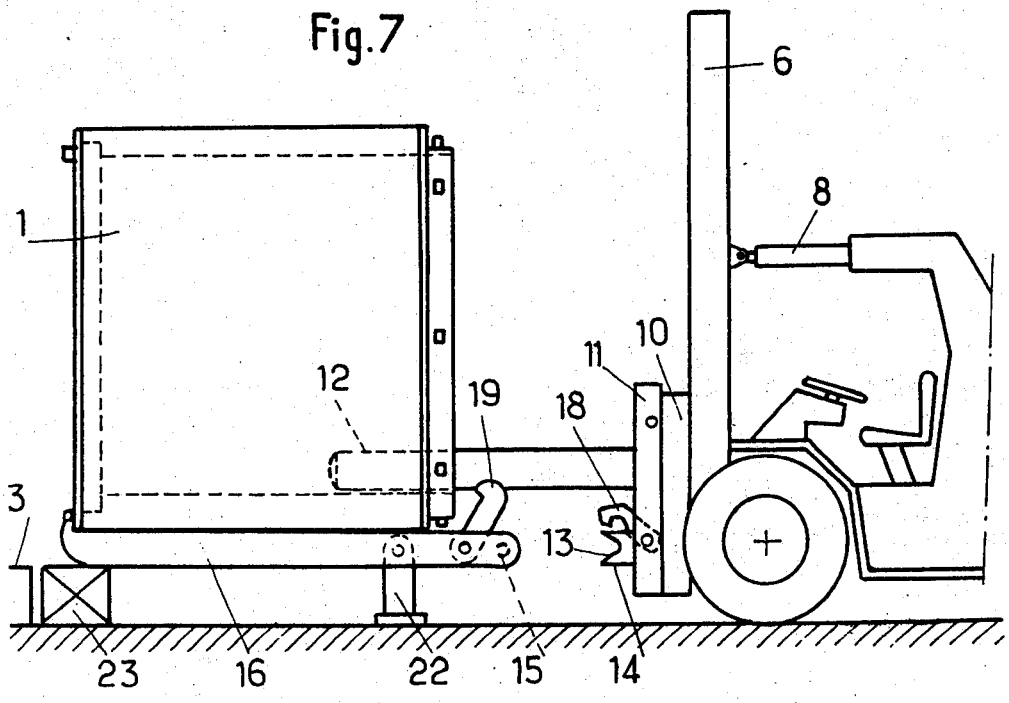
Figure 8:
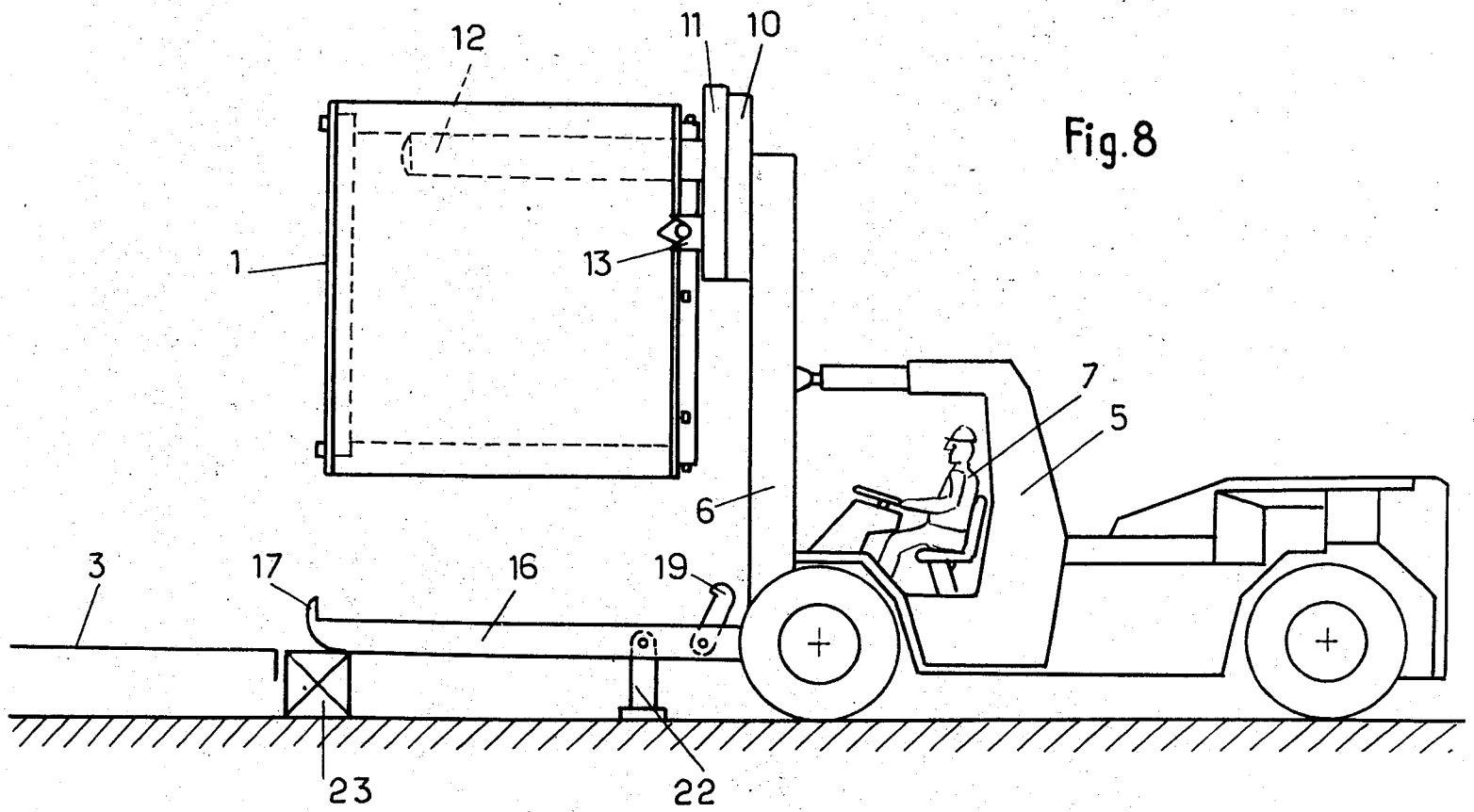

The invention will be more readily understood on reading the following description, reference being made to the accompanying drawings which show, in schematic elevation, an apparatus according to the invention, for handling a large concrete pipe, in the following states:

in FIG. 1, the prehension means of the lift truck about to take hold of the cylinder;

in FIG. 2, the gripping thereof by the nippers connected to the chassis of said truck;

in FIG. 3, the pipe beginning to tip when the truck moves backwards;

in FIG. 4, in half-tipped position, with the projection beginning to penetrate the pipe, when the truck moves further back;

in FIG. 5, more accentuated tipping and corresponding penetration of projection, whilst the truck moves further back;

in FIG. 6, end of tipping movement (i.e. the pipe is lying on its side) by a further rearward movement of the truck, the projection penetrating in the cylinder at maximum, and the pipe no longer being gripped by the nippers of the chassis of the truck;

in FIG. 7, disconnection of these nippers from the chassis of the truck, said truck reversing, in FIG. 8, finally, after the truck has moved forward, the pipe is lifted and can be subsequently displaced vertically, by dint of being supported by the projection.

Referring now to the drawings, the Figures show a straight concrete pipe 1, of length 250 cm, outer diameter 260 cm, thickness 20 cm, which has been manufactured in situ, by means known per se, and rests on a platform 3 with the interposition of a removable bottom (or disc) 4 provided with feet 2.

A conventional lifting truck 5 capable of lifting a load of 15 tons as a function of the mass of the cylinder 1 (about 10 tons) comprises a mast-like member 6 articulated at the front of the truck and controlled by the operator 7 by conventional hydraulic means (not shown), due to a piston 8, sliding in a cylinder **8*a* connected to a clevis 9 towards the centre of the mast 6. An apron 10** slides on said mast.

To said apron 10 there is firmly fixed a plate 11, which carries on the one hand, perpendicularly towards its free end, a projection 12 perpendicular thereto and on the other hand a clevis 13 comprising a half-bearing 14 (cf. FIG. 7) which may receive the pin 15 carried at one end of the chassis 16 of the truck in the form of a cradle, provided, at its other end, with a nipper 17.

There is also articulated on said plate 11 a hook 18 which keys the pin 15 when this latter is firmly engaged in the half-bearing 14 (cf. more particularly FIG. 7). On the chassis 16, near the hook 18 at the truck end with respect to nipper 17, there is mounted a beak 19 which is articulated to this chassis about an axis 20. The assembly is so dimensioned that the beak 19 may be engaged on the upper edge of the cylinder 1 and the nipper 17 is then disposed beneath the corresponding lower edge of this same cylinder, the two points of prehension being located along one and the same generatrix of the cylinder (cf. FIG. 2).

A prop 22, hanging vertically under the effect of its own weight and whose role will appear later, is articulated to the chassis 16 about axis 21.

Finally, a block 23, located at the same level as the platform 3 and nearby, is in a position to receive the nipper 17, when said latter is engaged beneath the lower edge of the cylinder 1, as may be clearly seen in FIG. 2.

The different manoeuvres to be effected with the apparatus described in order to carry out the method according to the invention, will now be explained.

As shown in FIG. 1, the operator 7 brings the lift truck up to the cylinder 1 to be moved, inclines the mast 6 slightly, causes the apron 10 carrying the plate 11 to move on said mast until the beak 19 is ready to grip the upper edge of the cylinder 1 and the nipper 17 to engage beneath the lower edge of this cylinder, whilst resting on the block 23.

At this moment, operator 7 straightens the mast 6, this imprisoning the upper edge of the cylinder 1 between the beak 19 and the chassis 16, and the nipper 17 engages beneath the lower edge of said cylinder, with abutment as indicated hereinabove, as shown in FIG. 2.

The operator 7, as illustrated in FIG. 3, then moves his truck 5 back slightly so that the beak 19 is firmly applied against the inner rim of the upper edge of the cylinder 1. In this operation, the chassis 16 is slightly oblique with respect to the axis of the cylinder 1.

The operator 7 continues to reverse his truck (cf. FIG. 4), but this time, whilst bringing down the apron 10 which is fast with plate 11, of which the clevis 13 is connected, by the interposition of the pin 15, to chassis 16, so that, in this manoeuvre, the cylinder 1 tips about the point of abutment of the nipper 17 on the block 23, the cylinder moving by its upper edge being pulled by the beak 19 towards the operator 7. In the course of this movement, the projection 12 begins to penetrate inside the cylinder 1 through the upper end which is open.

The rearward displacement of the truck continues, as shown in FIG. 5, and there comes a moment when the centre of gravity of the cylinder, hitherto beyond the point of abutment of the nipper 17 on the block 23, with respect to the truck 5, comes between the block and the truck and from this moment the cylinder 1 rests on chassis 16. In this way, the projection 12 has penetrated further into the cylinder 1.

At the end of the manoeuvre, this cylinder has now tipped completely on its side, as shown in FIG. 6, and is lying horizontally on the chassis 16 arranged as a cradle. At the end of displacement, the prop 22 which, in the course of the progressive rearward movement of the truck 5, had become more and more oblique with respect to the chassis 16, comes to rest on the ground.

When the cylinder 1 is in this way lying on its side, the beak 19 may be released from the upper edge thereof, since nothing more retains it (this was already the case as soon as cylinder 1 had passed over its point of equilibrium on the block 23).

At the end of the manoeuvre, the projection 12 is engaged in the cylinder 1 at a maximum and, in this latter case, occupies a position parallel to its axis, in the lower part.

The following operation, as clearly shown in FIG. 7, consists in releasing the truck from the cylinder 1-chassis 16 assembly. To this end, the hook 18 is rotated about its axis, this enabling the half-bearing 14 to be released from the pin 15. The truck may therefore move freely with respect to the cylinder 1.

The operator 7 then causes the apron 10-plate 11 assembly to move along the mast 6, taking the projection 12 with it, until said latter, having engaged at a maximum in the cylinder by the lift-truck 5 advancing, lifts this cylinder by supporting the upper generatric of the inner wall of the cylinder in question. In this position, the truck may transport the cylinder to any desired spot, particularly to a storage area (by placing in on its side surface so that it is easy to take again), on a loading lorry, railway wagon, waiting area before being picked up by a crane for loading on a ship, on a truck or for placing in the hold of a cargo-plane, etc.

It should be noted that in the course of the various manoeuvres described hereinabove, as soon as the pipe 1 has started to tip, by the nipper 17 of the chassis 16, about the point of abutment constituted by the block 23, and, a fortiori for reasons of safety when the tipping to horizontal has terminated, the disc 4 has been released from this cylinder and may therefore be recovered at that moment to be used again for manufacturing another pipe.

Whatever the case may be, all the interest of the process and equipment according to the invention will readily be appreciated, and one sole manoeuvring machine provided with simple, light and not bulky gripping members may handle heavy cylinders easily and in perfect safety, without it being necessary for there to be large surfaces, without any immobilisation of equipment and storage areas for substantial periods of time. This is all the technical and economic interest of the present invention.

The machine according to the invention has been more especially described with the only points of prehension of the bases of the cylinder being at the two opposite points of the generatrix of the vertical cylinder facing the operator. It is certain that, if desired, there may be more than two points of prehension, for example two in the upper part and one in the lower part, or better, one in the upper part and two in the lower part, the vertical plane passing through the single point constituting plane of symmetry for the other two. A line may also be used, viz. a surface of prehension or abutment, located in the upper or lower part.

The invention has been especially applied to concrete pipes, but it may of course be used for other bulky, heavy cylinders made of other material. Mention may be made of metal, particularly high density metal cylinders, glass cylinders, ceramic cylinders, plastics and even wooden cylinders and in this respect, the invention finds application in the manipulation of large electric or non-electric cable drums.

I claim:

1. Apparatus for moving a large heavy cylinder from an initial vertical position, wherein the cylinder rests on one end on a horizontal support surface, to a final horizontal position, said apparatus comprising, a lift truck including an articulated generally vertically extending mast a slide plate slidably mounted on said mast for movement in a generally vertical direction, a chassis-cradle having upper and lower portions, means for pivotally and removably connecting said chassis-cradle to said slide plate, said lower end portion of the chassis-cradle including nipper means for engaging the lower edge of a vertically positioned cylinder and said upper end portion including releasable beak means for gripping the upper edge portion of a vertically positioned cylinder directly above and in alignment with said nipper means, whereby downward movement of said slide plate along said mast and rearward movement of said lift truck away from said cylinder, while the upper and lower edges of the cylinder are engaged by said nipper and beak means, causes said cradle to pivot about its pivotal connection with said slide plate, thereby to tip the cylinder adjacent its lower edge, from its vertical position towards the truck and into a horizontal position;

said slide plate including a generally horizontally extending projection and support member secured thereto dimensioned to penetrate into said cylinder through the upper edge thereof during tilting of the cylinder to its horizontal position, whereby movement of said slide plate vertically on said mast, after the cylinder is tilted to the horizontal position and the chassis-cradle is disconnected from the slide plate, will cause the projection to engage the interior sidewall of the cylinder and support the cylinder for transport by said lift truck in said horizontal position.

2. Apparatus as defined in claim 1 wherein said chassis-cradle includes a prop support leg pivotally mounted thereon for engaging the ground when the cylinder is in its horizontal position to support the chassis-cradle in the horizontal position when the cradle is disconnected from said slide plate.

* * * * *